United States Patent [19]

Hazard

[11] 4,119,221

[45] Oct. 10, 1978

[54] PACK SEPARATION AND TRANSFER APPARATUS

[75] Inventor: James E. Hazard, Swarthmore, Pa.

[73] Assignee: Scott Paper Company, Philadelphia, Pa.

[21] Appl. No.: 780,982

[22] Filed: Mar. 24, 1977

[51] Int. Cl.[2] ..... B65G 47/26

[52] U.S. Cl. ..... 214/8.5 A; 93/93 K; 214/8.5 SS; 271/149

[58] Field of Search ..... 214/8.5 R, 8.5 A, 1 S, 214/8.5 B, 8.5 SS; 271/149, 150; 93/93 K; 198/425

[56] References Cited

U.S. PATENT DOCUMENTS

| | | | |
|---|---|---|---|
| 3,837,505 | 9/1974 | Muggli | 214/8.5 SS |
| 3,930,572 | 1/1976 | Fluck et al. | 198/425 X |

FOREIGN PATENT DOCUMENTS

| | | | |
|---|---|---|---|
| 2,427,635 | 12/1975 | Fed. Rep. of Germany | 214/8.5 R |
| 1,298,171 | 11/1972 | United Kingdom | 214/8.5 SS |

*Primary Examiner*—Frank E. Werner

*Attorney, Agent, or Firm*—Joseph H. Yamaoka; William J. Foley

[57] ABSTRACT

An apparatus for separating a lead pack from a continuously moving file of folded sheet objects such as paper napkins and transferring the pack to a work station. Each pack in the file is identified by a flag which projects a short distance from the file. A flag detector senses that a flag has reached a predetermined point along the path to indicate that the lead pack has advanced into a transfer pan. The flag detector initiates a separation and transfer cycle in which the lead pack is separated from the moving file and the transfer pan containing the lead pack is moved out of the path of the file and adjacent a work station where the pack is moved onto the work station.

11 Claims, 9 Drawing Figures

PACK SEPARATION AND TRANSFER APPARATUS

BACKGROUND OF THE INVENTION

This invention relates generally to an apparatus for separating a predetermined number of objects from a moving file and transferring them to a work station, and in particular to an apparatus for receiving a file of folded sheet objects, automatically separating a lead pack of the sheet objects from the file and automatically transferring the lead pack to a work station.

As a part of the process of converting a roll of paper into a package of the folded product, the paper is fed to a folding machine which cuts and folds the paper into the desired size. The folding machine places the folded sheet on its edge into a trough, creating a file of the product. As the folding process continues, the file of the folded product continually advances along the path of the trough. Normally, there is associated with the folding machine a means for counting a predetermined number of folded sheets to be packaged and means for inserting a flag between packs so that individual packs can be easily identified as the file proceeds along the trough. An operator, guided by the flag, manually grabs a lead pack or packs from the file and transfers them to the next work station which, for example, could be a conveyor which would transport the packs to a wrapping machine.

In one folding machine as described in U.S. Pat. No. 3,740,049, issued to David L. Fischer, the flag consists of one or more folded sheets that are displaced a fraction of an inch above the file. Another approach for separating packs of the folded product in the trough is illustrated in U.S. Pat. No. 3,866,905, issued to John F. Trogan, et al., wherein a metal finger, element 109, of FIG. 5, is inserted between packs in the trough.

The apparatus of this invention is particularly suitable for automatically separating and transferring the lead pack from a file of paper products separated by a flag as illustrated in the Fischer patent. While the prior art, as represented by the patents to Fischer and Trogan, et al., disclose the use of a flag to separate the packs within the trough, neither patent appears to disclose any apparatus for automatically separating and transferring individual packs from the file to the next work station.

It is, therefore, an object of this invention to provide an apparatus for receiving a file of objects separated into packs by means of a flag and automatically separating the lead pack from the file and transferring the lead pack to a work station.

SUMMARY OF THE INVENTION

In accordance with my invention, I provide an apparatus for accepting a continuously moving file of folded sheet objects such as paper napkins. The folded sheet objects in the file are separated into packs, each pack being identified by a flag which projects a short distance from the file. A flag detector senses that a flag has reached a predetermined point along the path to indicate that the lead pack in the file has advanced into a transfer pan. The flag detector initiates a separation and transfer cycle in which the lead pack is separated from the moving file and the transfer pan containing the lead pack is moved out of the path of the file and adjacent a work station. A transfer mechanism then moves the pack from the transfer pan to the work station.

In one aspect of my invention, the file is directed into the transfer pan from a trough that is inclined upward at about 35° with respect to the horizontal.

In another aspect of my invention, temporary support is provided for the lead sheets of the remaining, continuously moving file as the lead pack is separated from the file and transferred to the work station.

DESCRIPTION OF THE DRAWING

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 3:
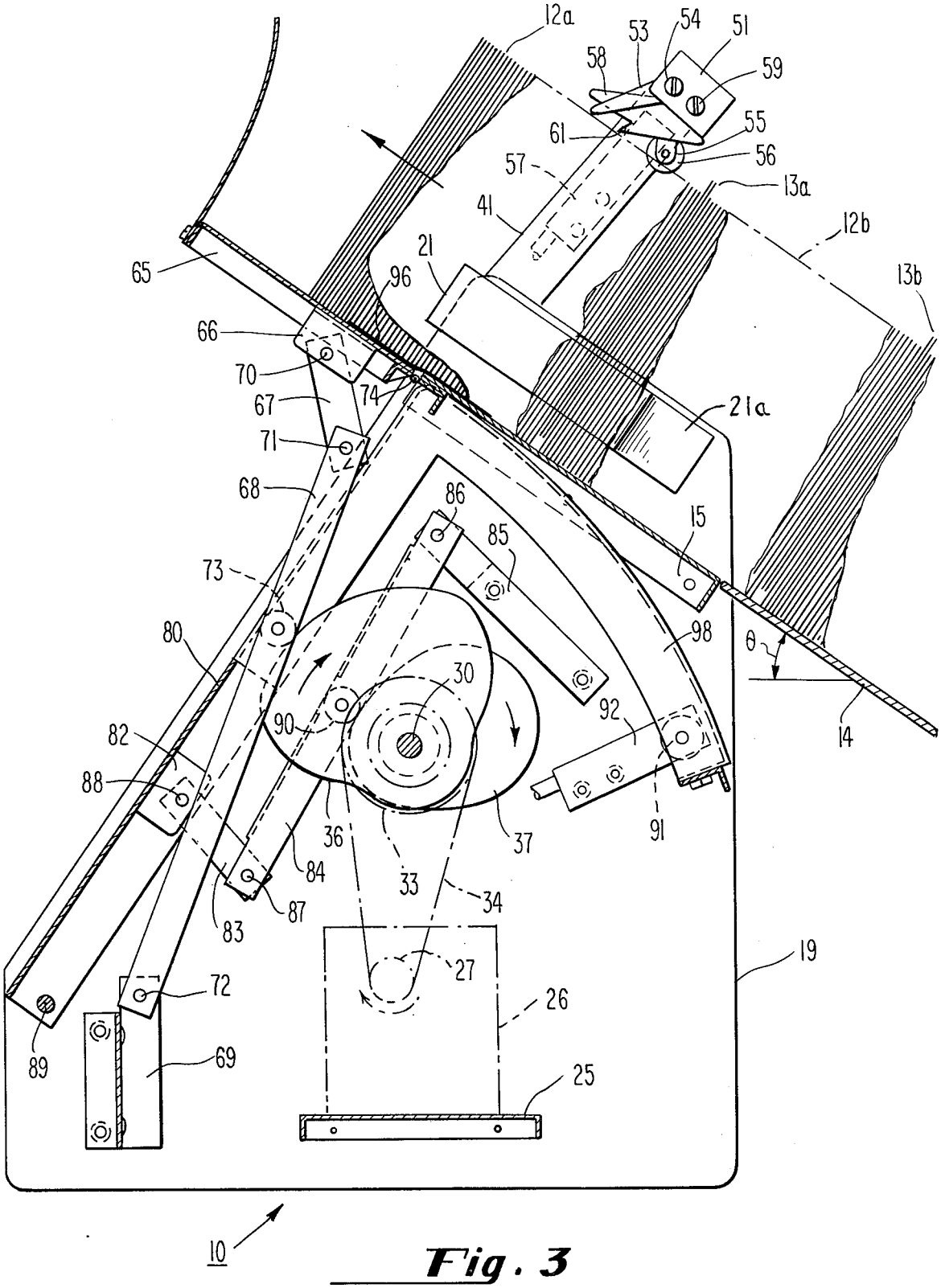
FIG. 3 is a sectional view taken on the line 3—3 of FIG. 2.

As shown in FIG. 3, the pack separation and transfer apparatus 10 of this invention can be used to handle a continuously moving file 12 of folded sheet objects, such as paper napkins or paper towels, moving in a trough 14. The file has a lead pack 12*a* of folded sheet objects that is separated from a second pack 12*b* of folded sheet objects by means of a flag 13*a*. Similarly, a second pack 12*b* is separated from the remainder of the file by means of another flag 13*b*. As disclosed in the aforementioned Fischer patent, each flag 13 can be formed by displacing several of the folded sheets so that the top edge of each flag sheet extends about ⅜ inch above the file.

Figure 4A:
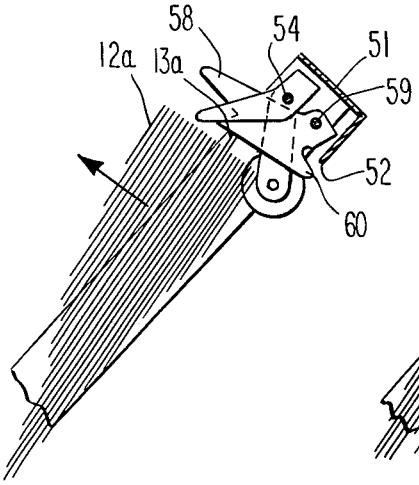
FIG. 4*a* is a partial side elevation showing the flag approaching the flag sensor.
Figure 4B:
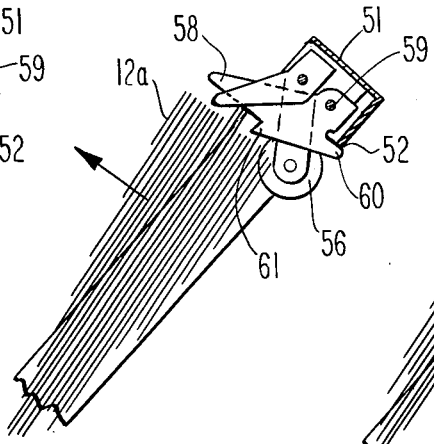
FIG. 4*b* is a partial side elevation showing the flag making initial contact with the flag sensor.
Figure 4C:
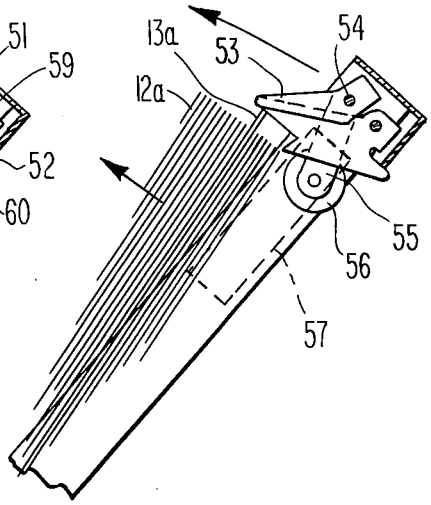
FIG. 4*c* is a partial side elevation showing the flag sensor in position to initiate the pack separation phase of the cycle.
Figure 4D:
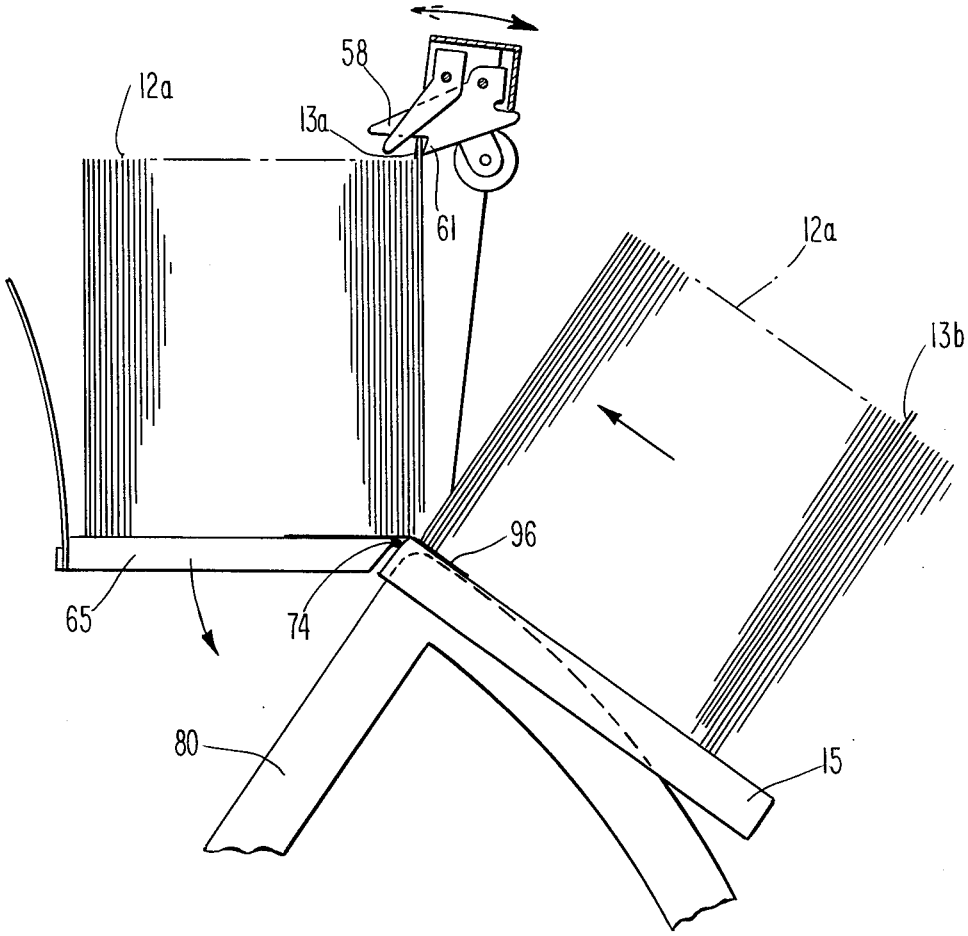
FIG. 4*d* is a partial side elevation illustrating the initiation of the pack separation.
Figure 4E:
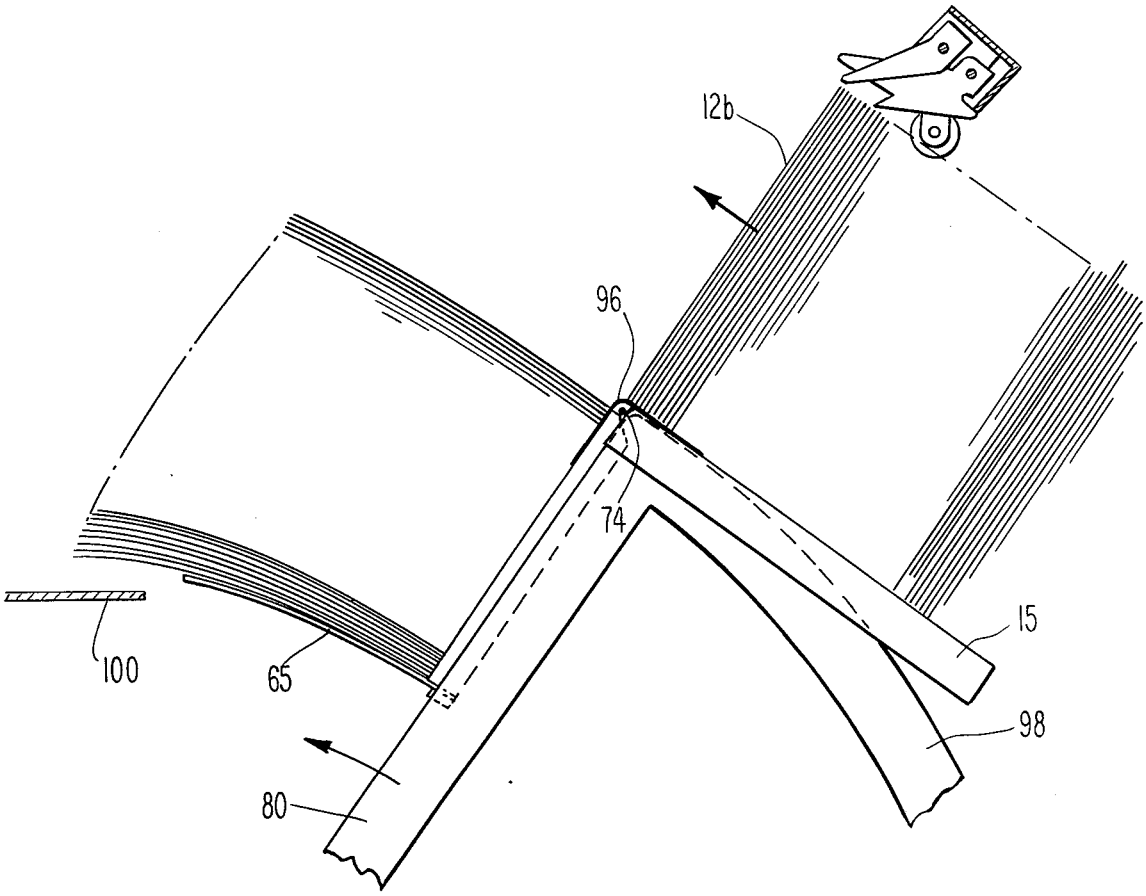
FIG. 4*e* is a partial side elevation that illustrates a pack at the completion of the separation phase just prior to transfer.

The purpose of the pack separation and transfer apparatus 10 is to automatically transfer the lead pack 12*a* of the folded sheets from the moving file 12 to a work station, shown as element 100 in FIG. 4*e*, and which for example could be a conveyor belt which would transport individual packs to a wrapping machine (not shown).

Figure 1:
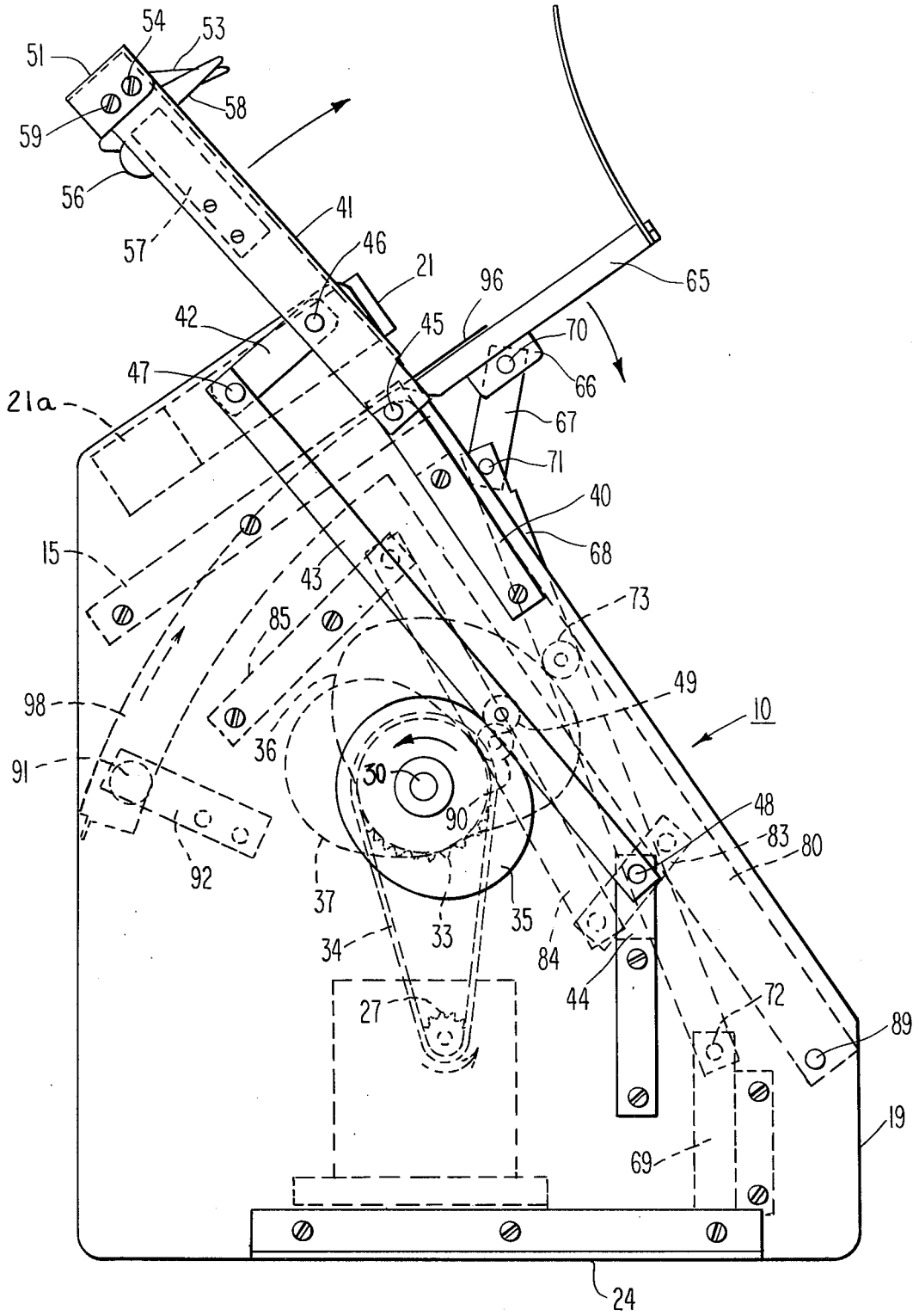
FIG. 1 is a side elevational view of the pack separation and transfer apparatus.
Figure 2:
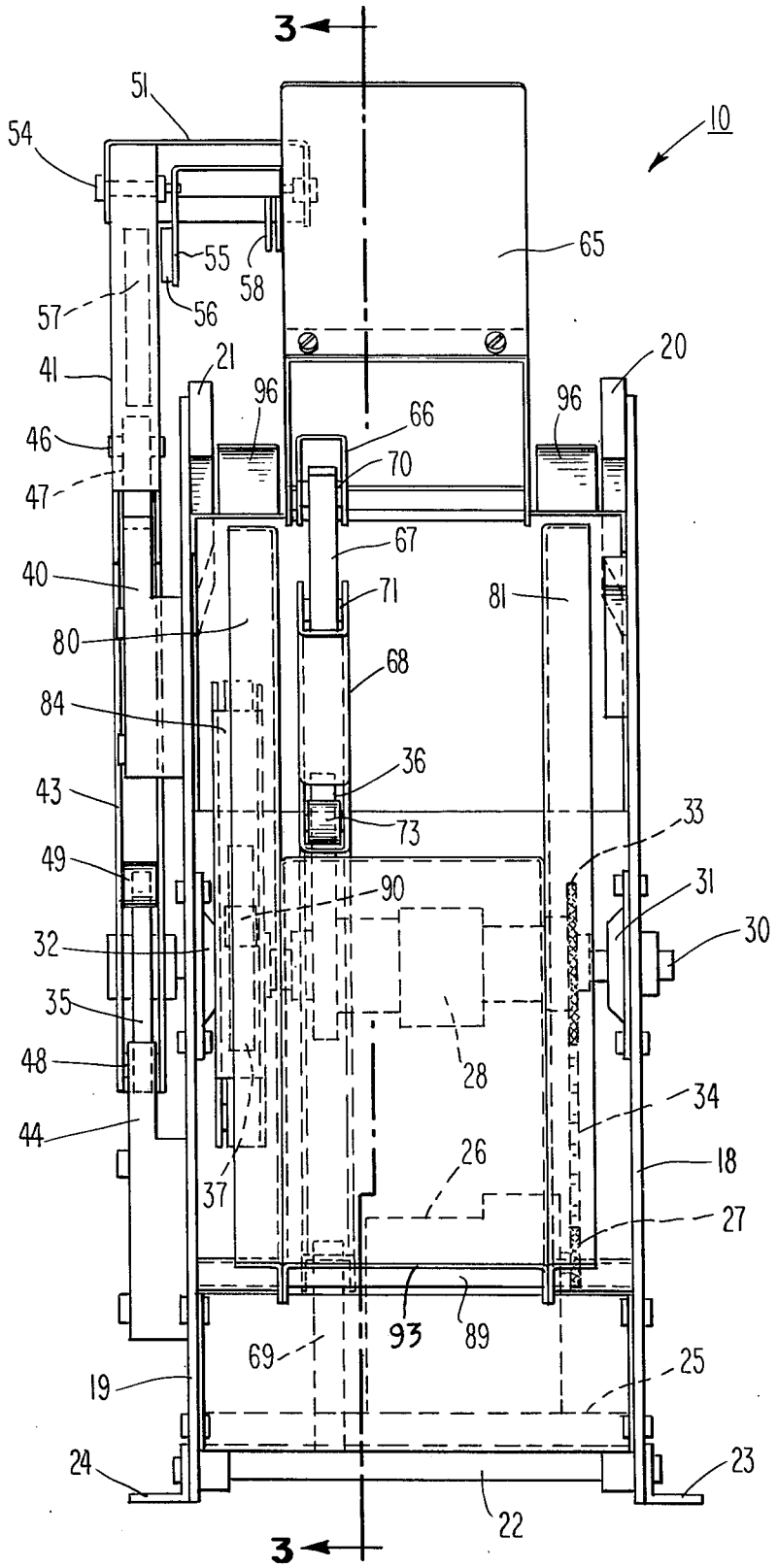
FIG. 2 is a front elevational view thereof.

For the sake of convenience, an element depicted in more than one Figure will retain the same element number in each Figure. As shown in FIGS. 1 through 3, the pack separation and transfer apparatus 10 includes a frame consisting of side plates 18 and 19 bolted to bottom frame member 22. Also bolted respectively to side plates 18 and 19 are angle-shaped foot members 23 and 24.

As shown in FIG. 3, the bottom of trough 14 is inclined upwardly at an angle $\theta$ with respect to the horizontal. A plate 15 is mounted between side plates 18 and 19 so that the upper surface of plate 15 acts as an extension of the bottom of trough 14. If the width of trough 14 exceeds the width of the folded sheets by more than ¼ inch, it may be desirable to mount spacers 20, 21 on each side plate 18, 19 whereby the leading portion of each spacer, as illustrated by elements 21*a* of FIGS. 1 and 3, can be tapered so that the width of the pack separating and transfer apparatus 10 is gradually reduced. The trough extension 15 terminates in a generally L-shaped transfer pan 65 that is connected to the trough extension 15 by a hinge 74.

In the discussion that follows, various members will be connected together by means of a pin. The pin, although securing the two members together, will allow the members to rotate with respect to each other about the pin. A pin connection support member 66 is attached to the transfer pan 65. One end of a movable link 67 is attached to support member 66 by a pin 70. The other end of movable link 67 is attached to one end of a movable link 68 by means of a pin 71. The other end of movable link 68 is connected to a pin support bracket 69 by means of a pin 72. Mounted on movable link 72 is a cam roller 73. The mechanism formed by transfer pan 65 and movable links 67 and 68 are known in the art as an open four link chain.

Referring now to FIG. 1, a flag pusher support member 41 is pivotally connected to the frame by means of a pin 45. One end of a movable link 42 is connected to support member 41 by means of a pin 46. The other end of movable link 42 is connected to one end of a movable link 43 by means of a pin 47. The other end of movable link 43 is connected, by means of a pin 48, to a pin connection support bracket 44 that is mounted to the side plate 19. A cam roller 49 is mounted on movable link 43. The flag pusher support member 41, along with movable links 42 and 43 also form an open four link chain.

A pivot support bracket 51 is attached to the flag pusher support member 41. Referring now to FIGS. 4*b* and 4*c*, the pivot support bracket 51 has mounted therein a flag sensor pivot 54 about which a flag sensor 53 can rotate. The flag sensor 53 includes as an integral part thereof an arm 55 which also rotates about pivot point 54. Mounted on arm 55 is a magnet 56. Mounted on the flag pusher support member 51 is a reed switch 57 that is controlled by magnet 56. Also mounted within the pivot support bracket 51 is a pivot 59 about which a flag pusher member 58 can rotate. The flag pusher member 58 includes a tooth 61 that engages the flag and assists in separating the lead pack 12*a* from the file. The flag pusher member 58 also includes a projection 60 which cooperates with an edge 52 of the pivot support bracket 51 in order to limit the counterclock-wise rotation of flag pusher member 58.

The separation and transfer apparatus 10 includes a pair of transfer arms 80, 81 which rotate about a shaft 89. Transfer arm 80 is connected to transfer arm 81 by means of a plate 93 so that the two transfer arms 80, 81 will rotate in unison about shaft 89. Transfer arm 80 has attached thereto a pin connection support bracket 82. One end of a movable link 83 is connected to support bracket 82 by means of a pin 88 and the other end of movable link 83 is connected to one end of a movable link 84 by means of a pin 87. The other end of movable link 84 is connected, by means of a pin 86, to a pin connection support bracket 85 mounted on side plate 19. A cam roller 90 is mounted on movable link 84. The transfer arm 80 along with movable links 83 and 84 also make up an open four link chain.

Each transfer arm includes an arcuate extension 98. Mounted on one arcuate extension 98 is a magnet 91. Mounted on the side plate 18 is a reed switch 92 that is controlled by magnet 91.

Figure 4F:
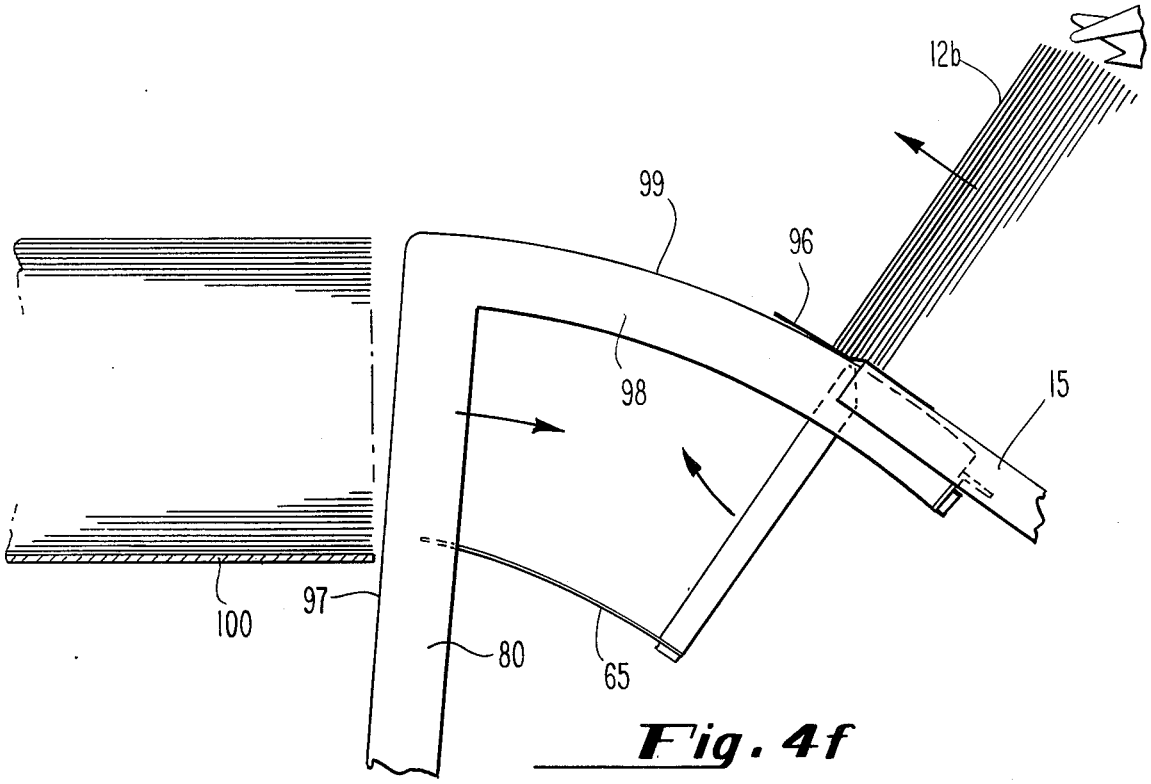
FIG. 4*f* is a partial side elevation illustrating the transfer of a pack to a work station.

Referring now to FIG. 4*f*, there is shown a sheet support assist member 96, which in a preferred embodiment is a piece of Mylar, one end of which is fastened to the trough extension memmber 15. The other end of the sheet support member 96 is allowed to project beyond the trough extension memmber 15 beside the L-shaped pan 65. The outside edge of the sheet support memmber 96 underlies the outer edge of the folded sheets in the file 12.

The motion of the flag pusher support member 41 is controlled by the shape of cam 35 which contacts cam roller 49. The motion of L-shaped pan 65 is controlled by the shape of cam 36 which contacts cam roller 73. The motion of transfer arms 80 and 81 is controlled by the shape of cam 37 which contacts cam roller 90. Cams 35, 36 and 37 are mounted on a cam shaft 30 mounted in bearing 31 in side plate 18 and in bearing 32 in side plate 19. Cam shaft 30 is intermittently driven from a single revolution clutch assembly 28. Drive means for the single revolution clutch 28 is provided by a sprocket 33, attached to said clutch, that is driven by means of a chain 34 and a drive sprocket 27 attached to the shaft of a motor 26 which is mounted on a plate 25. Normally, motor 26 continuously drives sprocket 33. The single revolution clutch assembly 28 is solenoid operated. Power to the solenoid is applied through the contacts of reed switch 57. When the flag sheets pass under the flag sensor thereby causing magnet 56, which rotates in unison with flag sensor 53, to be placed sufficiently near reed switch 57 so as to close the contacts thereof, power is applied to the solenoid of the single revolution clutch assembly 28. The single revolution clutch assembly 28 engages cam shaft 30 and causes cam shaft 30 to rotate 360° after which the clutch assembly 28 is disengaged from shaft 30 until another reed switch 57 closure occurs.

The shape of cam 36, which contacts cam roller 73, controls the motion of L-shaped pan 65. As shown in FIG. 3, L-shaped pan 65 is in the rest position. During the initial portion of a cam cycle, L-shaped pan 65 is caused to rotate approximately 90° about hinge 74. This causes the lead pack 12*a* of the file to be moved out of the path of the continuously moving file. During the latter portion of the cycle of cam 36, the L-shaped pan 65 is returned to the rest position for receiving the next pack from the continuously moving file.

The shape of cam 35 which contacts cam roller 49 controls the motion of the flag pusher support member 41. As best illustrated in FIG. 4*d*, the function of flag pusher member 41 is to maintain tooth 61 behind flag 13*a* to initiate the separation of the lead pack 12*a* from the file and to provide for the transfer of the flag sheets 13*a* with the lead pack 12*a*. As shown in FIG. 1, the pivot point 45 for flag pusher support member 41 is located very close to the hinge 74 of L-shaped pan 65 so that tooth 61 will maintain contact with the back of flag 13*a* when the flag pusher support member 41 rotates in synchronism with pan 65. It is not necessary for the flag pusher member 41 to rotate through a full 90° as does L-shaped pan 65. In a preferred embodiment of this invention the flag pusher support member rotates through 41°.

As shown in FIG. 2, the width of L-shaped pan 65 is considerably less than the width of the folded sheets, which have previously been described as being slightly less the distance between the side walls of spacers 20 and 21. The width of L-shaped pan 65 is also less than the spacing between the interior edges to transfer arms 80 and 81. Therefore, as best illustrated in FIGS. 4*e* and 4*f*, after the L-shaped pan 65 has been rotated down and out of the path of the continuously moving file 12, the edges of the folded sheets will overhang the sides of L-shaped pan 65 and will be in the path of transfer arms 80 and 81. As the transfer arms 80 and 81 are caused to pivot about shaft 89, as determined by the shape of cam 37, they contact the overhanging edges of the folded sheets and push the lead pack off of L-shaped pan 65 and onto the work station 100. Tthe transfer arms 80 and 81 are then returned to the rest position as shown in FIG. 1.

FIG. 4*e* and 4*f* also illustrate the cooperation of the arcuate extension 98 of transfer arm 80 with flexible member 96 to provide temporary support for the lead sheets of the remainder of the advancing file. As the transfer arms 80, 81 pivot about shaft 89 to transfer the lead pack 12*a* of folded sheets from the pan 65 to the work station 100, the upper surface 99 of arcuate extensions 98 is extended beneath the lead sheets in the remaining file. If flexible material 96 were not present, the bottom of the lead sheets in the remaining file 12*b* would try to rest on the upper surface 99 of the arcuate extension 98 and, as the transfer arm 80 pivoted, the upper surface 99 of the arcuate extension would pull the lead sheets away from the remaining file. Thus, flexible member 96 isolates the bottom edges of the lead sheets in the file from the motion of the upper surface 99 of arcuate extension 98 while still allowing surface 99 to support the lead sheets of the file as the file advances beyond the hinge point 74 of the L-shaped pan 65. As best shown in FIGS. 4*d* and 4*e*, as L-shaped pan 65 rotates about hinge 74, the member 96 should also flex around hinge 74 so that the lead pack 12*a* will maintain its arrangement in the L-shaped pan 65. As transfer arms 80 and 81 transfer the pack 12*a* from the pan 65 to the work station 100, the upper surface 99 of arcuate extension 98 straightens out the flexible member 96 and provides temporary support for the lead sheets of the remaining file.

During the initial separation of the lead pack 12*a* from the next pack 12*b* in the file, a partial vacuum is created between the last flag sheet 13*a* and the first sheet in the next pack 12*b*. This partial vacuum applies a force to the lead sheets of the next pack 12*b* which tends to pull them away from the remaining file. If the file motion is in a perfectly horizontal direction, then any slight vacuum force on the lead sheets would cause the lead sheets to move in the direction of the rotation of pan 65, and then gravity will cause the sheet to remain with the pack in pan 65. By inclining the end of the trough 14 and the trough extension 15 upward at an angle of between 33° and 37°, the forces on the lead sheets of the remaining file that are generated during the separation of the lead pack from the file are not sufficient to pull or rotate the lead sheets past the vertical, and gravity will cause the lead sheets to fall back into the remaining file. It will be apparent to those skilled in the art that means, such as wire retainers (not shown) attached to spacers 20 and 21, could contact and restrain the lead sheets of the remaining file thereby allowing trough extension 15 to be inclined at an angle less than 33° to the horizontal.

The overall operation of the pack separation and transfer apparatus 10 will now be described. Referring to FIG. 3 there is shown a continuously moving file 12 of folded sheets that is progressing from trough 14 onto trough extension 15 and into the L-shaped pan 65. The initial pack 12*a* is shown about halfway into pan 65 and is separated from the next pack 12*b* by several flag sheets 13*a* that have been displaced so that they extend a short distance above the file 12. As shown in FIG. 4*a*, as the file continues to move, flag sheets 13*a* contact the bottom edge of the flag pusher 58 which causes flag pusher 58 to rotate about pivot point 59 thereby allowing the flag sheets 13*a* to pass under the flag pusher member 58 with a minimum of disturbance. As the file continues to advance into pan 65, the flag sheets 13*a* reach the position illustrated in FIG. 4*b* wherein they pass beyond the tooth 61 of flag pusher member 58. The gravitational force acting on flag pusher 58 causes it to rotate counterclockwise so that the tooth 61 is positioned behind the flag 13*a*. The counterclockwise rotation of flag pusher 58 is limited by projection 60 which contacts edge 52 of flag pusher support member 51. As the file continues to advance into pan 65 the flag 13*a* pushes against the bottom surface of flag sensor 53 causing it along with magnet 56 to rotate about pivot point 54. When the flag sheets 13*a* have reached a predetermined point in the apparatus, the lead pack 12*a* will be in pan 65 and magnet 56 will be so located as to operate reed switch 57. The closure of reed switch 57 causes power to be applied to the solenoid which operates the single revolution clutch assembly 28. During a first portion of the cycle, flag pusher support member 41 is pivoted about pin 45, and tooth 61 acting on the rear of flag shets 13*a*, initiates the separation of lead pack 12*a* and flag sheets 13*a* from the file. During a second portion of the cycle, pan 65 which is pivoted about hinge 74, rotates in synchronism with flag pusher support member 41 to reach the position of FIG. 4*d*. During a third portion of the cycle the pan 65 continues to pivot about hinge 74 until the initial pack 12*a* is completely out of the path of the remaining file and flag pusher support member 41 is rotated in the clockwise direction and is returned to the resting position as illustrated in FIG. 4*e*. During the fourth portion of the cycle, transfer arms 80 and 81 are caused to pivot about shaft 89 which transfers the lead pack 12*a* from pan 65 to work station surface 100 as indicated in FIG. 4*f*. During the fifth portion of the cycle, pan 65 and transfer arms 80 and 81 are returned to their rest positions to await the arrival of the next pack 12*b* in the file. When transfer arm 80 returns to the rest position, magnet 91 attached to arcuate extension 98 operates reed switch 92 to provide a signal indicating the completion of the cycle.

While the present invention has been described with reference to a specific embodiment thereof it will be obvious to those skilled in the art that various changes and modifications may be made without departing from the invention in its broader aspects. For example, although the flag sensor 53 of the preferred embodiment utilizes a mechanical sensor to cause the operation of a reed switch 57 that is responsive to the location of a magnet 56, it will be clear to those skilled in the art that other flag detecting means such as a light source and a photoelectric cell can be used to detect the presence of the flag. The magnetically operated signaling device is preferred when the apparatus is handling paper products because the response of a photoelectric signalling device can be adversely affected by buildup of paper fibers and dust on the components thereof. Furthermore, flag sensor 53 does not have to move with flag pusher support member 41 but could remain stationary. It will also be apparent to those skilled in the art that the flag pusher support member 41 does not have to be driven independently of pan 65. For example, the flag pusher support member 41 can be attached to pan 65 so that the flag pusher member 58 moves in unison with pan 65 thereby eliminating the linkage that drives flag pusher support member 41.

What is claimed as new and desired to be secured by Letters Patent of the United States is:

1. An apparatus for transferring a lead group of objects from a moving file to a station, each group being identified by a flag that projects a predetermined distance from the file, comprising:

(a) a hinged pan located in the path of the file for receiving objects from the moving file;

(b) flag detecting means for generating a signal when a flag has reached a predetermined point, said signal indicating that a group of objects is on the pan;

(c) a pan rotation mechanism operatively connected to the pan, responsive to the flag detection signal, for rotating the pan and the group of objects contained therein, out of the path of the moving file and adjacent to the station;

(d) a flag separation mechanism, also responsive to the flag detection signal and adapted to move in synchronism with the rotating pan, for separating the flag from the moving file and for causing the flag to travel with the group of objects in the rotating pan; and (e) a transfer mechanism operable when the pan is adjacent to the station for transferring the group of objects from the pan to the station.

2. An apparatus for transferring a lead pack of sheets from a moving file to a station, each pack being identified by a flag that projects a predetermined distance from the file, comprising:

(a) a hinged, L-shaped pan located in the path of the file for receiving sheets from the file;

(b) flag detecting means for generating a signal when a lead flag has reached a predetermined point, said signal indicating that the lead pack of sheets is on the pan;

(c) a pack separating tooth located adjacent to the pan and projecting into the path of the flag, said tooth being adapted to allow the flag to be advanced past the tooth and onto the pan;

(d) pack transfer means located adjacent to the station for transferring a pack of sheets from the pan to the station;

(e) a first mechanism, operatively connected to the hinged pan for rotating the pan down and out of the path of the moving file and adjacent to the station;

(f) a second mechanism, operatively connected to the pack separating tooth for moving the tooth in synchronism with the rotating pan so that the tooth contacts the rear of the flag to assist in separating the pack and the flag from the moving file;

(g) a third mechanism connected to the pack transfer means for operating the transfer means when the pan is adjacent to the station; and (h) motorized cam means responsive to the flag detection signal for operating the first, second and third mechanisms.

3. An apparatus as recited in claim 2 wherein the flag detecting means comprises:

(a) a pivoted finger projecting into the path of the flag;

(b) a magnet mounted to move with the pivoted finger; and (c) means responsive to the field of the magnet for generating the flag detecting signal when a flag causes the pivoted finger and magnet to move the flag passes by the predetermined point.

4. An apparatus as recited in claim 2 further comprising a trough, inclined upwardly between 33° and 37° to the horizontal, in the path of the moving file of packs, the pan being located at the end of the inclined trough.

5. An apparatus as recited in claim 4 wherein the width dimension of the pan perpendicular to the motion of the file is less than the width of the sheet and wherein sheets received on the pan extend beyond both sides of the pan, said transfer means comprising a pair of arms and wherein the third mechanism causes the arms to push against the edges of the sheets that extend beyond the sides of the pan and causes the arms to travel along the sides of the pan to push the pack from the pan to the station.

6. An apparatus as recited in claim 5 wherein the transfer means includes a support member attached to each transfer arm, said support members being projected beneath the outer edges of the lead sheets of the remaining file as the lead pack is being transferred from the pan to the station thereby providing temporary support for the lead sheets of the remaining file until the pan is returned to a position for receiving the lead sheets of the remaining file.

7. An apparatus as recited in claim 6 further comprising a resilient support member normally in the plane of the bottom of the trough and extending beside the pan, the resilient support member underlying the outer edges of the lead sheets of the remaining file and overlies the transfer arm support members, said lead pack of sheets causing the extended portion of the resilient member to bend around the hinge as the pan is rotated down and out of the path of the remaining file, said extended portion of the resilient support member springing back to the plane of the trough bottom after the lead pack of sheets has been transferred from the pan to the station.

8. An apparatus as recited in claim 7 wherein the flag detecting means comprises:

(a) a pivoted finger projecting into the path of the flag;

(b) a magnet mounted to move with the pivoted finger; and (c) means responsive to the field of the magnet for generating the flag detecting signal when a flag moving causes the pivoted finger and magnet to move when the flag passes by the predetermined point.

9. An apparatus as recited in claim 2 wherein the width dimension of the pan perpendicular to the motion of the file is less than the width of the sheet and wherein sheets received on the pan extend beyond both sides of the pan, said transfer means comprising a pair of arms and wherein the third mechanism causes the arms to push against the edges of the sheets that extend beyond the sides of the pan and to travel along the sides of the pan to push the pack from the pan to the station.

10. An apparatus as recited in claim 2 wherein the transfer means comprises a pair of transfer arms each having attached thereto a support extension, said support extensions being projected beneath the outer edges of the lead sheets of the remaining file as the lead pack is being transferred from the pan to the station thereby providing temporary support for the lead sheets of the remaining file until the pan is returned to a position for receiving the sheets of the remaining file.

11. An apparatus as recited in claim 2 further comprising a resilient support member normally in the plane of the bottom of the trough and extending onto the pan, the resilient support member underlying the outer edges of the lead sheets of the remaining file and overlies the transfer arm support members, said lead pack of sheets causing the extended portion of the resilient member to bend around the hinge as the pan is rotated down and out of the path of the remaining file, said extended portion of the resilient support member returning to the plane of the trough bottom after the lead pack of sheets has been transferred from the pan to the station.

* * * * *